US010006335B2

(12) United States Patent
Gonze et al.

(10) Patent No.: US 10,006,335 B2
(45) Date of Patent: Jun. 26, 2018

(54) COOLANT TEMPERATURE CORRECTION SYSTEMS AND METHODS

(71) Applicant: GM Global Technology Operations LLC, Detroit, MI (US)

(72) Inventors: Eugene V. Gonze, Pickney, MI (US); Christopher H. Knieper, Chesaning, MI (US); Vijay A. Ramappan, Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 232 days.

(21) Appl. No.: 14/932,139

(22) Filed: Nov. 4, 2015

(65) Prior Publication Data

US 2017/0122182 A1 May 4, 2017

(51) Int. Cl.

*F01P 5/10* (2006.01)
*F01P 7/16* (2006.01)
*F01P 3/18* (2006.01)

(52) U.S. Cl.

CPC ..... *F01P 7/164* (2013.01); *F01P 3/18* (2013.01); *F01P 5/10* (2013.01); *F01P 2025/32* (2013.01); *F01P 2025/40* (2013.01); *F01P 2025/52* (2013.01)

(58) Field of Classification Search

CPC ..... F01P 7/164; F01P 3/18; F01P 5/10; F01P 2025/32; F01P 2025/52; F01P 2025/40

See application file for complete search history.

(56) References Cited

U.S. PATENT DOCUMENTS 5,724,924 A * 3/1998 Michels ..... F01P 7/044 123/41.12
2004/0173012 A1* 9/2004 Tsukamoto ..... F01P 11/14 73/114.71
2007/0175415 A1* 8/2007 Rizoulis ..... F01P 7/14 123/41.05
2010/0212338 A1* 8/2010 Hermann ..... B60H 1/00278 62/118
2011/0120146 A1* 5/2011 Ota ..... B60H 1/00885 62/3.3

(Continued)

FOREIGN PATENT DOCUMENTS

JP 2013168281 A * 8/2013

*Primary Examiner* — Jacob Amick
*Assistant Examiner* — Charles Brauch

(57) ABSTRACT

A coolant control system of a vehicle includes an adjusting module that: (i) receives an engine output coolant temperature measured at a coolant output of an internal combustion engine; (ii) adjusts the engine output coolant temperature based on a reference temperature to produce a first adjusted coolant temperature; (iii) receives an engine input coolant temperature measured at a coolant input of the internal combustion engine; and (iv) adjusts the engine input coolant temperature based on the reference temperature to produce a second adjusted coolant temperature. The coolant control system also includes a difference module that determines a difference between the first and second adjusted coolant temperatures. The coolant control system also includes a pump control module that controls a coolant output of a coolant pump based on the difference between the first and second adjusted coolant temperatures.

20 Claims, 4 Drawing Sheets

(56) References Cited

U.S. PATENT DOCUMENTS

| | | | | |
|---|---|---|---|---|
| 2012/0291754 | A1* | 11/2012 | Yamaguchi | F02D 41/2464<br>123/458 |
| 2014/0020641 | A1* | 1/2014 | Shimoyama | F01P 7/14<br>123/41.52 |
| 2014/0298818 | A1* | 10/2014 | Kurosaka | F02C 3/22<br>60/776 |

* cited by examiner

COOLANT TEMPERATURE CORRECTION SYSTEMS AND METHODS

FIELD

The present disclosure relates to vehicles with internal combustion engines and more particularly to coolant temperature correction systems and methods.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

In a feature, a coolant control system of a vehicle is described. An adjusting module: (i) receives an engine output coolant temperature measured at a coolant output of an internal combustion engine; (ii) adjusts the engine output coolant temperature based on a reference temperature to produce a first adjusted coolant temperature; (iii) receives an engine input coolant temperature measured at a coolant input of the internal combustion engine; and (iv) adjusts the engine input coolant temperature based on the reference temperature to produce a second adjusted coolant temperature. A difference module determines a difference between the first and second adjusted coolant temperatures. A pump control module controls a coolant output of a coolant pump based on the difference between the first and second adjusted coolant temperatures.

In further features, the pump control module selectively adjusts at least one of a speed and a displacement of the coolant pump based on a comparison of the difference between the first and second adjusted coolant temperatures and a target temperature difference.

In further features, a reference module sets the reference temperature based on a temperature of coolant at a radiator of the vehicle when an ambient temperature is less than a predetermined temperature.

In further features, the reference module sets the reference temperature based on an average of a plurality of measured temperatures when the ambient temperature is greater than the predetermined temperature.

In further features, the measured temperatures include at least two of: (i) the temperature of coolant at the radiator; (ii) a transmission fluid temperature; (iii) an engine oil temperature; (iv) a first temperature of coolant output from a heater core; (v) a second temperature of coolant input to the heater core; (vi) a third temperature of coolant at a block portion of the internal combustion engine; and (vii) a fourth temperature of coolant within an integrated exhaust manifold (IEM) of the internal combustion engine.

In further features, the measured temperatures include all of: (i) the temperature of coolant at the radiator; (ii) a transmission fluid temperature; (iii) an engine oil temperature; (iv) a first temperature of coolant output from a heater core; (v) a second temperature of coolant input to the heater core; (vi) a third temperature of coolant at a block portion of the internal combustion engine; and (vii) a fourth temperature of coolant within an integrated exhaust manifold (IEM) of the internal combustion engine.

In further features, when the engine output coolant temperature is less than the reference temperature, the adjusting module increases the engine output coolant temperature based on the reference temperature to produce the first adjusted coolant temperature.

In further features, when the engine output coolant temperature is greater than the reference temperature, the adjusting module decreases the engine output coolant temperature based on the reference temperature to produce the first adjusted coolant temperature.

In further features, when the engine input coolant temperature is less than the reference temperature, the adjusting module increases the engine input coolant temperature based on the reference temperature to produce the second adjusted coolant temperature.

In further features, when the engine input coolant temperature is less than the reference temperature, the adjusting module decreases the engine input coolant temperature based on the reference temperature to produce the second adjusted coolant temperature.

In a feature, a coolant control method is described. The coolant control method includes: receiving an engine output coolant temperature measured at a coolant output of an internal combustion engine; adjusting the engine output coolant temperature based on a reference temperature to produce a first adjusted coolant temperature; receiving an engine input coolant temperature measured at a coolant input of the internal combustion engine; adjusting the engine input coolant temperature based on the reference temperature to produce a second adjusted coolant temperature; determining a difference between the first and second adjusted coolant temperatures; and controlling a coolant output of a coolant pump based on the difference between the first and second adjusted coolant temperatures.

In further features, controlling the coolant output of the coolant pump includes adjusting at least one of a speed and a displacement of the coolant pump based on a comparison of the difference between the first and second adjusted coolant temperatures and a target temperature difference.

In further features, the coolant control method further includes setting the reference temperature based on a temperature of coolant at a radiator of the vehicle when an ambient temperature is less than a predetermined temperature.

In further features, the coolant control method further includes setting the reference temperature based on an average of a plurality of measured temperatures when the ambient temperature is greater than the predetermined temperature.

In further features, the measured temperatures include at least two of: (i) the temperature of coolant at the radiator; (ii) a transmission fluid temperature; (iii) an engine oil temperature; (iv) a first temperature of coolant output from a heater core; (v) a second temperature of coolant input to the heater core; (vi) a third temperature of coolant at a block portion of the internal combustion engine; and (vii) a fourth temperature of coolant within an integrated exhaust manifold (IEM) of the internal combustion engine.

In further features, the measured temperatures include all of: (i) the temperature of coolant at the radiator; (ii) a transmission fluid temperature; (iii) an engine oil temperature; (iv) a first temperature of coolant output from a heater core; (v) a second temperature of coolant input to the heater core; (vi) a third temperature of coolant at a block portion of the internal combustion engine; and (vii) a fourth temperature of coolant within an integrated exhaust manifold (IEM) of the internal combustion engine.

In further features, when the engine output coolant temperature is less than the reference temperature, adjusting the engine output coolant temperature includes increasing the engine output coolant temperature based on the reference temperature to produce the first adjusted coolant temperature.

In further features, when the engine output coolant temperature is greater than the reference temperature, adjusting the engine output coolant temperature includes decreasing the engine output coolant temperature based on the reference temperature to produce the first adjusted coolant temperature.

In further features, when the engine input coolant temperature is less than the reference temperature, adjusting the engine input coolant temperature includes increasing the engine input coolant temperature based on the reference temperature to produce the second adjusted coolant temperature.

In further features, when the engine input coolant temperature is less than the reference temperature, adjusting the engine input coolant temperature includes decreasing the engine input coolant temperature based on the reference temperature to produce the second adjusted coolant temperature.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts air and fuel to generate drive torque. A coolant system includes a coolant pump that circulates coolant through various portions of the engine, such as a cylinder head, an engine block, and an integrated exhaust manifold (IEM). Engine coolant is used to absorb heat from the engine, engine oil, transmission fluid, and other components and to transfer heat to air via one or more heat exchangers. The engine coolant, however, can also be used to warm various components to decrease frictional losses and increase fuel efficiency. A coolant valve controls how coolant flows back to the coolant pump, through the engine, and through other components.

An engine coolant input temperature sensor measures a temperature of coolant at an input to the engine. An engine coolant output temperature sensor measures a temperature of coolant at an output of the engine. A control module controls coolant flow through the engine based on a temperature difference between the temperatures measured by the engine coolant input and output temperature sensors.

Accuracy of the engine coolant input and output temperature sensors, however, are +/− a predetermined temperature from actual. According to the present disclosure, the control module adjusts the temperatures measured by the engine coolant input and output temperature sensors based on a reference temperature. Adjusting the temperatures increases the accuracy of the temperature difference and allows the control module to more closely regulate coolant flow, for example, to prevent coolant temperature(s) being greater than a predetermined temperature.

Figure 1:
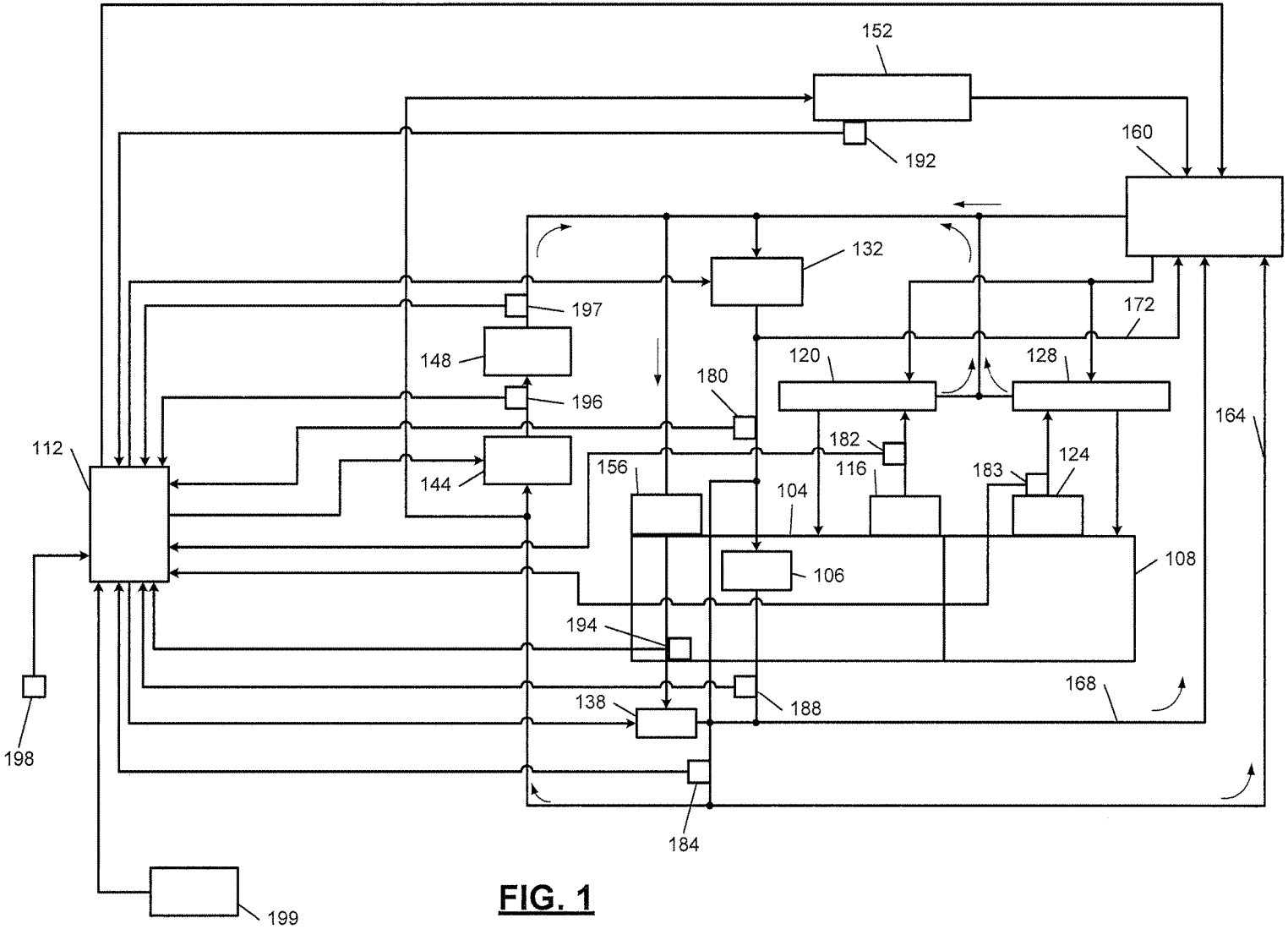
FIG. 1 is a functional block diagram of an example vehicle system.

Referring now to FIG. 1, a functional block diagram of an example vehicle system is presented. An engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104. The engine 104 also includes a block portion.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

The engine 104 includes a plurality of channels through which engine coolant ("coolant") can flow. For example, the engine 104 may include one or more channels through the head portion of the engine 104, one or more channels through the block portion of the engine 104, and/or one or more channels through the IEM 106. The engine 104 may also include one or more other suitable coolant channels.

When a coolant pump 132 is on, the coolant pump 132 pumps coolant to various channels. The coolant pump 132 may be an electric coolant pump that pumps coolant based on electrical power applied to a motor of the coolant pump 132.

A block valve (BV) 138 may regulate coolant flow out of (and therefore through) the block portion of the engine 104. A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle.

Coolant output from the engine 104 also flows to a fourth heat exchanger 152. The fourth heat exchanger 152 may be referred to as a radiator. The fourth heat exchanger 152 transfers heat to air passing the fourth heat exchanger 152. A cooling fan (not shown) may be implemented to increase airflow passing the fourth heat exchanger 152.

Various types of engines may include one or more turbochargers, such as turbocharger 156. Coolant may be circulated through a portion of the turbocharger 156, for example, to cool the turbocharger 156.

A coolant valve 160 may include a multiple input, multiple output valve or one or more other suitable valves. In various implementations, the coolant valve 160 may be partitioned and have two or more separate chambers. An example diagram illustrating coolant flow to and from an example where the coolant valve 160 includes two coolant chambers is provided in FIG. 2. The ECM 112 controls actuation of the coolant valve 160.

Figure 2:
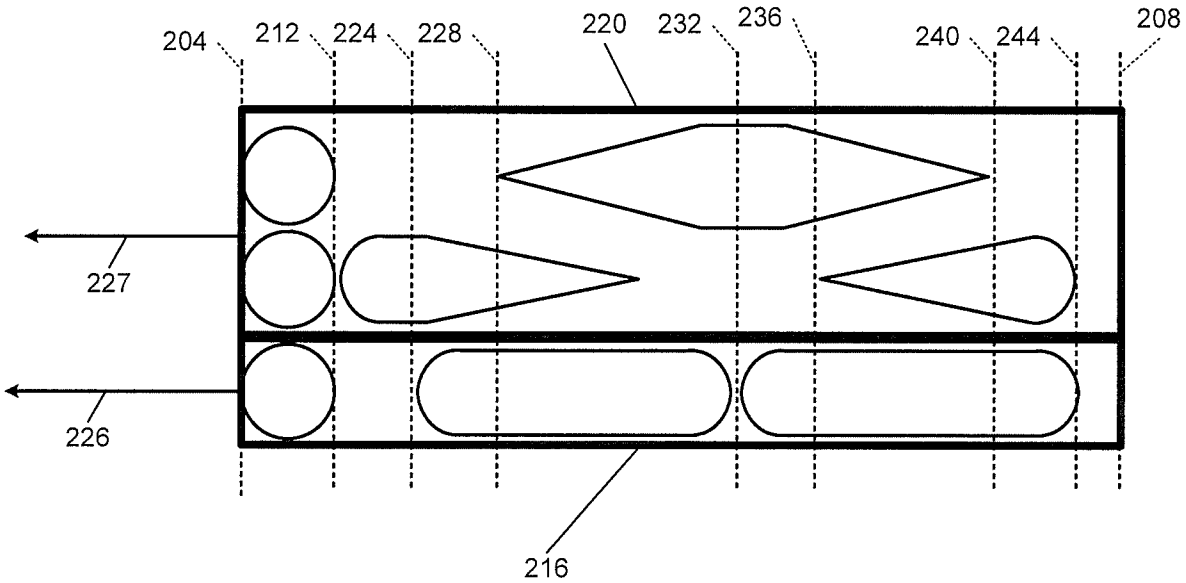
FIG. 2 is an example diagram illustrating coolant flow to and from a coolant valve for various positions of the coolant valve.

Referring now to FIGS. 1 and 2, the coolant valve 160 can be actuated between two end positions 204 and 208. When the coolant valve 160 is positioned between the end position 204 and a first position 212, coolant flow into a first one of the chambers 216 is blocked, and coolant flow into a second one of the chambers 220 is blocked. The coolant valve 160 outputs coolant from the first one of the chambers 216 to the first heat exchanger 120 and the second heat exchanger 128, as indicated by 226. The coolant valve 160 outputs coolant from the second one of the chambers 220 to the coolant pump 132, as indicated by 227.

When the coolant valve 160 is positioned between the first position 212 and a second position 224, coolant flow into the first one of the chambers 216 is blocked and coolant output by the engine 104 flows into the second one of the chambers 220 via a first coolant path 164. Coolant flow into the second one of the chambers 220 from the fourth heat exchanger 152, however, is blocked.

When the coolant valve 160 is positioned between the second position 224 and a third position 228, coolant output by the IEM 106 via a second coolant path 168 flows into the first one of the chambers 216, coolant output by the engine 104 flows into the second one of the chambers 220 via the first coolant path 164, and coolant flow into the second one of the chambers 220 from the fourth heat exchanger 152 is blocked. The ECM 112 may actuate the coolant valve 160 to between the second and third positions 224 and 228, for example, to warm the engine oil and the transmission fluid.

When the coolant valve 160 is positioned between the third position 228 and a fourth position 232, coolant output by the IEM 106 via the second coolant path 168 flows into the first one of the chambers 216, coolant output by the engine 104 flows into the second one of the chambers 220 via the first coolant path 164, and coolant output by the fourth heat exchanger 152 flows into the second one of the chambers 220. Coolant flow into the first one of the chambers 216 from the coolant pump 132 via a third coolant path 172 is blocked when the coolant valve 160 is between the end position 204 and the fourth position 232. The ECM 112 may actuate the coolant valve 160 to between the third and fourth positions 228 and 232, for example, to warm the engine oil and the transmission fluid.

When the coolant valve 160 is positioned between the fourth position 232 and a fifth position 236, coolant output by the coolant pump 132 flows into the first one of the chambers 216 via the third coolant path 172, coolant flow into the second one of the chambers 220 via the first coolant path 164 is blocked, and coolant output by the fourth heat exchanger 152 flows into the second one of the chambers 220. When the coolant valve 160 is positioned between the fifth position 236 and a sixth position 240, coolant output by the coolant pump 132 flows into the first one of the chambers 216 via the third coolant path 172, coolant output by the engine 104 flows into the second one of the chambers 220 via the first coolant path 164, and coolant output by the fourth heat exchanger 152 flows into the second one of the chambers 220.

When the coolant valve 160 is positioned between the sixth position 240 and a seventh position 244, coolant output by the coolant pump 132 flows into the first one of the chambers 216 via the third coolant path 172, coolant output by the engine 104 flows into the second one of the chambers 220 via the first coolant path 164, and coolant flow from the fourth heat exchanger 152 into the second one of the chambers 220 is blocked.

Coolant flow into the first one of the chambers 216 from the IEM 106 via the second coolant path 168 is blocked when the coolant valve 160 is between the fourth position 232 and the seventh position 244. The ECM 112 may actuate the coolant valve 160 to between the fourth and seventh positions 232 and 244, for example, to cool the engine oil and the transmission fluid. Coolant flow into the first and second chambers 216 and 220 is blocked when the coolant valve 160 is positioned between the seventh position 244 and the end position 208. The ECM 112 may actuate the coolant valve 160 to between the seventh position 244 and the end position 208, for example, for performance of one or more diagnostics.

Referring back to FIG. 1, an engine input temperature sensor 180 measures a temperature of coolant input to the engine 104. An oil temperature sensor 182 measures a temperature of engine oil. A transmission fluid temperature sensor 183 measures a temperature of transmission fluid. An engine output temperature sensor 184 measures a temperature of coolant output from the engine 104. An IEM coolant temperature sensor 188 measures a temperature of coolant output from the IEM 106.

A radiator coolant temperature sensor 192 measures a temperature of coolant within the fourth heat exchanger 152. An engine block coolant temperature sensor 194 measures a temperature coolant within the block portion of the engine 104. A heater input temperature sensor 196 measures a temperature of coolant at an input to the third heat exchanger 148. A heater output temperature sensor 197 measures a temperature of coolant output from the third heat exchanger 148. An ambient temperature sensor 198 measures an ambient (e.g., air) temperature. One or more other sensors 199 may be implemented, such as a crankshaft position sensor, a mass air flowrate (MAF) sensor, a manifold absolute pressure (MAP) sensor, and/or one or more other suitable vehicle sensors. One or more other heat exchangers may also be implemented to aid in cooling and/or warming of vehicle fluid(s) and/or components.

The ECM 112 controls the coolant valve 160 based on the coolant input temperature and the coolant output temperature measured using the engine input temperature sensor 180 and the engine output temperature sensor 184. The ECM 112 may control the coolant valve 160, for example, based on a target difference between the coolant input and output temperatures.

The engine input and output temperature sensors 180 and 184, however, each have a predetermined temperature accuracy. For example, the engine input and output temperature sensors 180 and 184 may each be designed to be accurate to +/−3.5 degrees Celsius (° C.) of actual temperature, although +/−3.5° C. is only one example. In other words, tolerances of the engine input and output temperature sensors 180 and 184 may be +/−3.5° C. of actual in one example. In this example, the difference between the engine coolant input and output temperatures may therefore be +/−7° C. from an actual temperature difference under some circumstances.

According to the present disclosure, the ECM 112 determines a reference coolant temperature and adjusts the engine input and output temperatures based on the reference coolant temperature. This increases the accuracy of the difference between the coolant input and output temperatures.

Figure 3:
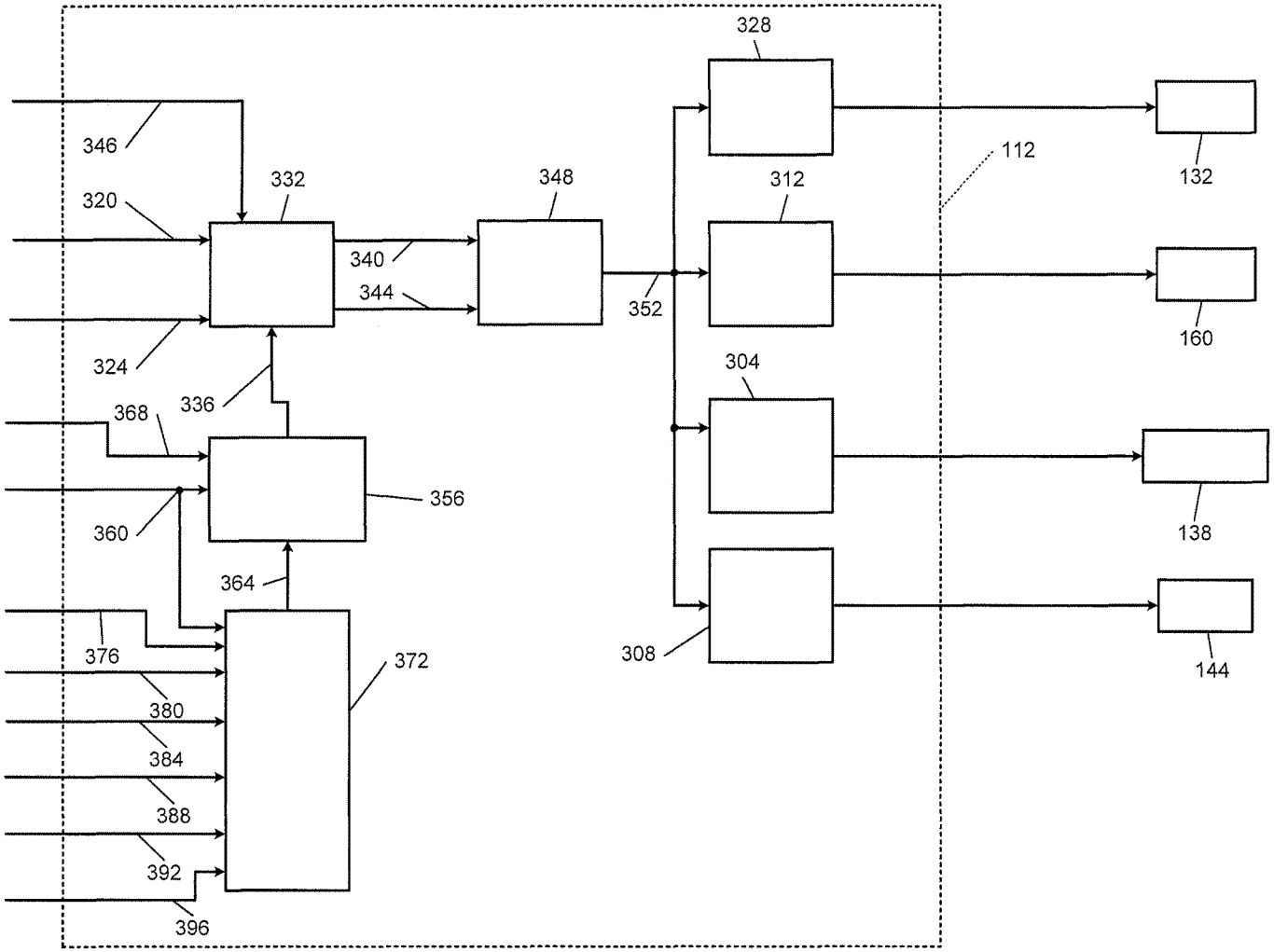
FIG. 3 is a functional block diagram of an example engine control module.

Referring now to FIG. 3, a functional block diagram of an example portion of the ECM 112 is presented. A block valve control module 304 controls the block valve 138. For example, the block valve control module 304 controls whether the block valve 138 is open (to allow coolant flow through the block portion of the engine 104) or closed (to prevent coolant flow through the block portion of the engine 104).

A heater valve control module 308 controls the heater valve 144. For example, the heater valve control module 308 controls whether the heater valve 144 is open (to allow coolant flow through the third heat exchanger 148) or closed (to prevent coolant flow through the third heat exchanger 148).

A coolant valve control module 312 controls the coolant valve 160. As described above, the position of the coolant valve 160 controls coolant flow into the chambers of the coolant valve 160 and also controls coolant flow out of the coolant valve 160. As discussed further below, the coolant valve control module 312 may control the coolant valve 160, for example, based on a difference an engine coolant output temperature 320 and an engine coolant input temperature 324.

A pump control module 328 controls the coolant pump 132. As discussed further below, the pump control module 328 may control the coolant pump 132 based on a difference the engine coolant output temperature 320 and the engine coolant input temperature 324. For example, the pump control module 328 may determine a target coolant flowrate through the engine 104 based on (or as a function of) an engine torque and an engine speed. The pump control module 328 may adjust the target coolant flowrate based on the difference between the engine coolant input temperature 324, and the engine coolant output temperature 320. The pump control module 328 may determine a target speed of the coolant pump 132 based on the target coolant flowrate. The pump control module 328 controls the coolant pump 132 to achieve the target speed. For example, the pump control module 328 controls the application of electrical power to the motor of the coolant pump 132 to achieve the target speed. In various implementations, the pump control module 328 may control application of electrical power to the motor in closed loop to adjust an actual speed of the coolant pump 132 toward the target speed. Additionally or alternatively, the pump control module 328 may control a displacement of the coolant pump 132 based on the target coolant flowrate.

The engine coolant output temperature 320 is measured using the engine output temperature sensor 184. The engine coolant input temperature 324 is measured using the engine input temperature sensor 180. As described above, however, the engine coolant output and input temperatures 320 and 324 may be different than actual engine coolant output and input temperatures, respectively, by up to a predetermined maximum amount (e.g., 3.5° C.).

An adjusting module 332 therefore adjusts the engine coolant output and input temperatures 320 and 324 based on a reference temperature 336 to produce adjusted engine coolant output and input temperatures 340 and 344, respectively. For example, when the engine coolant output temperature 320 is greater than the reference temperature 336, the adjusting module 332 may set the adjusted engine coolant output temperature 340 based on or equal to the engine coolant output temperature 320 minus the reference temperature 336. When the engine coolant output temperature 320 is not greater than the reference temperature 336, the adjusting module 332 may set the adjusted engine coolant output temperature 340 based on or equal to the engine coolant output temperature 320 plus the reference temperature 336.

When the engine coolant input temperature 324 is greater than the reference temperature 336, the adjusting module 332 may set the adjusted engine coolant input temperature 344 based on or equal to the engine coolant input temperature 324 minus the reference temperature 336. When the engine coolant input temperature 324 is not greater than the reference temperature 336, the adjusting module 332 may set the adjusted engine coolant input temperature 344 based on or equal to the engine coolant input temperature 324 plus the reference temperature 336.

The adjusting module 332 may the adjusting the engine coolant output and input temperatures 320 and 324 when an engine off period 346 before engine startup is greater than a predetermined period. Engine startup may be initiated via one or more ignition keys, buttons, and/or switches. The engine off period 346 may correspond to a period between an engine startup and a last engine shutdown before that engine startup.

A difference module 348 sets a temperature difference 352 based on or equal to a difference between the adjusted engine coolant output temperature 340 and the adjusted engine coolant input temperature 344. The coolant valve control module 312 controls the coolant valve 160 based on the temperature difference 352. For example, the pump control module 328 may control the coolant pump 132 to adjust the temperature difference 352 toward a target difference between engine coolant input and output temperatures. One or more other actuators may additionally or alternatively be controlled to adjust the temperature difference 352 toward the target difference. For example, the coolant valve control module 312 may control the coolant valve 160 to adjust the temperature difference 352 toward the target difference. The block valve control module 304 may control opening of the block valve 138 to adjust the temperature difference 352 toward the target difference. The heater valve control module 308 may control opening of the heater valve 144 to adjust the temperature difference 352 toward the target difference. The target difference between engine coolant input and output temperatures may be predetermined and may be fixed or variable.

A reference module 356 determines the reference temperature 336. The reference module 356 sets the reference temperature 336 based on or equal to one of (i) a radiator coolant temperature 360 and (ii) an average temperature 364. For example, the reference module 356 may set the reference temperature 336 based on or equal to the radiator coolant temperature 360 when an ambient (e.g., air) temperature 368 is less than a predetermined temperature. When the ambient temperature 368 is greater than the predetermined temperature, the reference module 356 may set the reference temperature 336 based on or equal to the average temperature 364. The radiator coolant temperature 360 may be measured using the radiator coolant temperature sensor 192.

An averaging module 372 determines the average temperature 364 based on two or more measured temperatures. For example, the averaging module 372 may set the average temperature 364 based on or equal to an average of the radiator coolant temperature 360, a transmission fluid temperature 376, an engine oil temperature 380, a heater coolant output temperature 384, a heater coolant input temperature 388, a block coolant temperature 392, and an IEM coolant temperature 396. The transmission fluid temperature 376 is measured using the transmission fluid temperature sensor 183. The engine oil temperature 380 is measured using the oil temperature sensor 182. The heater coolant output temperature 384 is measured using the heater output temperature sensor 197. The heater coolant input temperature 388 is measured using the heater input temperature sensor 196. The block coolant temperature 392 is measured using the block coolant temperature sensor 194. The IEM coolant temperature 396 is measured using the IEM coolant temperature sensor 188.

Figure 4:
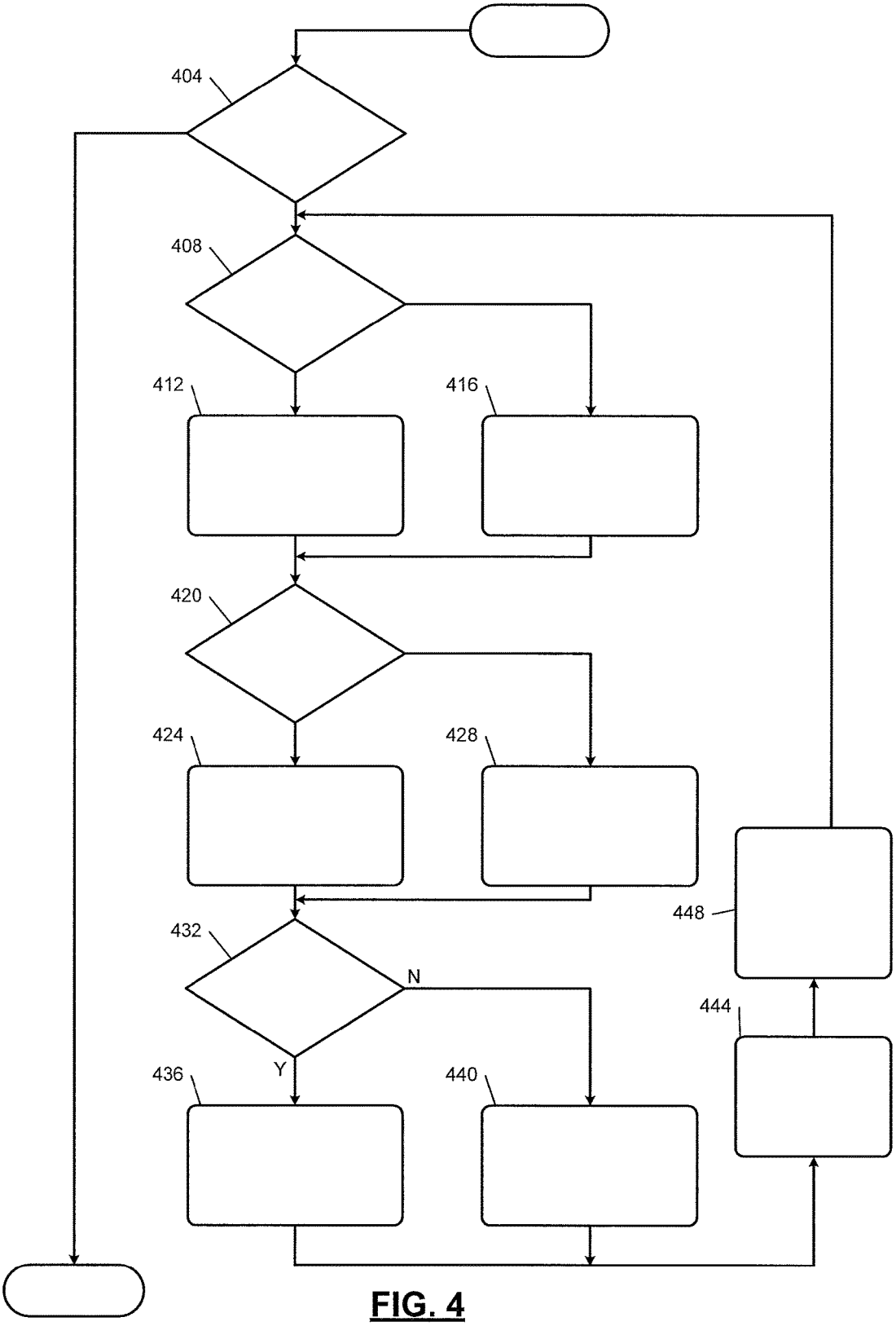
FIG. 4 is a flowchart depicting an example of adjusting measured engine output and input coolant temperatures.

FIG. 4 is a flowchart depicting an example method for adjusting the engine output and input coolant temperatures 320 and 324. Control may begin an engine startup. At 404, the adjusting module 332 may determine whether the engine off period 346 is greater than the predetermined period. If 404 is true, control continues 408. If 404 is false, the adjusting module 332 may set the adjusted engine output and input temperatures 340 and 344 based on or equal to the engine coolant output and input temperatures 320 and 324, respectively, and control may end. In various implementations, 404 may be omitted, and control may begin with 408.

At 408, the reference module 356 determines whether the ambient temperature 368 is less than the predetermined temperature. If 404 is true, the reference module 356 may set the reference temperature 336 based on or equal to the radiator coolant temperature 360 at 412, and control continues with 420. If 404 is false, the reference module 356 may set the reference temperature 336 based on or equal to the average temperature 364 at 416, and control continues with 420. The averaging module 372 sets the average temperature 364 based on or equal to an average of the radiator coolant temperature 360, the transmission fluid temperature 376, the engine oil temperature 380, the heater coolant output temperature 384, the heater coolant input temperature 388, the block coolant temperature 392, and the IEM coolant temperature 396.

The adjusting module 332 determines whether the engine coolant input temperature 324 is greater than the reference temperature 336 at 420. If 420 is true, the adjusting module 332 sets the adjusted engine coolant input temperature 344 based on or equal to the engine coolant input temperature 324 minus the reference temperature 336 at 424, and control continues with 432. If 420 is false, the adjusting module 332 sets the adjusted engine coolant input temperature 344 based on or equal to the engine coolant input temperature 324 plus the reference temperature 336 at 428, and control continues with 432.

At 432, the adjusting module 332 determines whether the engine coolant output temperature 320 is greater than the reference temperature 336. If 432 is true, the adjusting module 332 sets the adjusted engine coolant output temperature 340 based on or equal to the engine coolant output temperature 320 minus the reference temperature 336 at 436. If 432 is false, the adjusting module 332 sets the adjusted engine coolant output temperature 340 based on or equal to the engine coolant output temperature 320 plus the reference temperature 336 at 440.

The difference module 348 determines the temperature difference 352 at 444 based on a difference between the adjusted engine coolant output and input temperatures 340 and 344. At 448, the pump control module 328 controls the coolant pump 132 two adjust the temperature difference 352 toward the target difference between the coolant input and output temperatures. Additionally or alternatively, the block valve 138, the heater valve 144, and/or the coolant valve 160 may be controlled based on the temperature difference 352. Control may return to 408.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A coolant control system of a vehicle, comprising:

an adjusting module that: (i) receives an engine output coolant temperature measured at a coolant output of an internal combustion engine; (ii) adjusts the engine output coolant temperature based on a reference temperature to produce a first adjusted coolant temperature; (iii) receives an engine input coolant temperature measured at a coolant input of the internal combustion engine; and (iv) adjusts the engine input coolant temperature based on the reference temperature to produce a second adjusted coolant temperature;

a difference module that determines a difference between the first and second adjusted coolant temperatures; and a pump control module that controls a coolant output of a coolant pump based on the difference between the first and second adjusted coolant temperatures.

2. The coolant control system of claim 1 wherein the pump control module selectively adjusts at least one of a speed and a displacement of the coolant pump based on a comparison of the difference between the first and second adjusted coolant temperatures and a target temperature difference.

3. The coolant control system of claim 1 further comprising a reference module that sets the reference temperature based on a temperature of coolant at a radiator of the vehicle when an ambient temperature is less than a predetermined temperature.

4. The coolant control system of claim 3 wherein the reference module sets the reference temperature based on an average of a plurality of measured temperatures when the ambient temperature is greater than the predetermined temperature.

5. The coolant control system of claim 4 wherein the measured temperatures include at least two of:

(i) the temperature of coolant at the radiator;

(ii) a transmission fluid temperature;

(iii) an engine oil temperature;

(iv) a first temperature of coolant output from a heater core;

(v) a second temperature of coolant input to the heater core;

(vi) a third temperature of coolant at a block portion of the internal combustion engine; and (vii) a fourth temperature of coolant within an integrated exhaust manifold (IEM) of the internal combustion engine.

6. The coolant control system of claim 4 wherein the measured temperatures include all of:

(i) the temperature of coolant at the radiator;

(ii) a transmission fluid temperature;

(iii) an engine oil temperature;

(iv) a first temperature of coolant output from a heater core;

(v) a second temperature of coolant input to the heater core;

(vi) a third temperature of coolant at a block portion of the internal combustion engine; and (vii) a fourth temperature of coolant within an integrated exhaust manifold (IEM) of the internal combustion engine.

7. The coolant control system of claim 1 wherein, when the engine output coolant temperature is less than the reference temperature, the adjusting module increases the engine output coolant temperature based on the reference temperature to produce the first adjusted coolant temperature.

8. The coolant control system of claim 1 wherein, when the engine output coolant temperature is greater than the reference temperature, the adjusting module decreases the engine output coolant temperature based on the reference temperature to produce the first adjusted coolant temperature.

9. The coolant control system of claim 1 wherein, when the engine input coolant temperature is less than the reference temperature, the adjusting module increases the engine input coolant temperature based on the reference temperature to produce the second adjusted coolant temperature.

10. The coolant control system of claim 1 wherein, when the engine input coolant temperature is less than the reference temperature, the adjusting module decreases the engine input coolant temperature based on the reference temperature to produce the second adjusted coolant temperature.

11. A coolant control method for a vehicle, comprising:

receiving an engine output coolant temperature measured at a coolant output of an internal combustion engine;

adjusting the engine output coolant temperature based on a reference temperature to produce a first adjusted coolant temperature;

receiving an engine input coolant temperature measured at a coolant input of the internal combustion engine;

adjusting the engine input coolant temperature based on the reference temperature to produce a second adjusted coolant temperature;

determining a difference between the first and second adjusted coolant temperatures; and controlling a coolant output of a coolant pump based on the difference between the first and second adjusted coolant temperatures.

12. The coolant control method of claim 11 wherein controlling the coolant output of the coolant pump includes adjusting at least one of a speed and a displacement of the coolant pump based on a comparison of the difference between the first and second adjusted coolant temperatures and a target temperature difference.

13. The coolant control method of claim 11 setting the reference temperature based on a temperature of coolant at a radiator of the vehicle when an ambient temperature is less than a predetermined temperature.

14. The coolant control method of claim 13 further comprising setting the reference temperature based on an average of a plurality of measured temperatures when the ambient temperature is greater than the predetermined temperature.

15. The coolant control method of claim 14 wherein the measured temperatures include at least two of:

(i) the temperature of coolant at the radiator;

(ii) a transmission fluid temperature;

(iii) an engine oil temperature;

(iv) a first temperature of coolant output from a heater core;

(v) a second temperature of coolant input to the heater core;

(vi) a third temperature of coolant at a block portion of the internal combustion engine; and (vii) a fourth temperature of coolant within an integrated exhaust manifold (IEM) of the internal combustion engine.

16. The coolant control method of claim 14 wherein the measured temperatures include all of:

(i) the temperature of coolant at the radiator;

(ii) a transmission fluid temperature;

(iii) an engine oil temperature;

(iv) a first temperature of coolant output from a heater core;

(v) a second temperature of coolant input to the heater core;

(vi) a third temperature of coolant at a block portion of the internal combustion engine; and (vii) a fourth temperature of coolant within an integrated exhaust manifold (IEM) of the internal combustion engine.

17. The coolant control method of claim 11 wherein, when the engine output coolant temperature is less than the reference temperature, adjusting the engine output coolant temperature includes increasing the engine output coolant temperature based on the reference temperature to produce the first adjusted coolant temperature.

18. The coolant control method of claim 11 wherein, when the engine output coolant temperature is greater than the reference temperature, adjusting the engine output coolant temperature includes decreasing the engine output coolant temperature based on the reference temperature to produce the first adjusted coolant temperature.

19. The coolant control method of claim 11 wherein, when the engine input coolant temperature is less than the reference temperature, adjusting the engine input coolant temperature includes increasing the engine input coolant temperature based on the reference temperature to produce the second adjusted coolant temperature.

20. The coolant control method of claim 11 wherein, when the engine input coolant temperature is less than the reference temperature, adjusting the engine input coolant temperature includes decreasing the engine input coolant temperature based on the reference temperature to produce the second adjusted coolant temperature.

* * * * *